US005356109A

United States Patent [19]

Biasini

[11] Patent Number: 5,356,109

[45] Date of Patent: Oct. 18, 1994

[54] MUSIC SUPPORT APPARATUS AND METHOD

[76] Inventor: Americole Biasini, 2101 Ontario, Bellingham, Wash. 98226

[21] Appl. No.: 195,878

[22] Filed: Feb. 14, 1994

[51] Int. Cl.[5] ..... A47B 97/04

[52] U.S. Cl. ..... 248/448; 248/441.1; 281/45

[58] Field of Search ..... 248/441.1, 451, 454, 248/455, 456, 465, 463, 464, 448, 460; 281/45

[56] References Cited

U.S. PATENT DOCUMENTS

| | | | |
|---|---|---|---|
| 575,729 | 1/1897 | Palmer | 248/448 |
| 1,037,233 | 9/1912 | Furrow | 248/448 |
| 2,882,641 | 4/1959 | Young | 248/448 |
| 3,269,043 | 8/1966 | Swanson | 248/460 X |
| 3,637,172 | 1/1972 | Diesbach | 248/460 |
| 4,312,490 | 1/1982 | Biasini | 248/441.1 X |
| 4,360,183 | 11/1982 | Biasini | 248/444.1 X |
| 4,372,518 | 2/1983 | Biasini | 248/441.1 |
| 4,610,417 | 9/1986 | Kuss | 248/460 |
| 4,655,427 | 4/1987 | Lamb | 281/45 X |
| 4,813,644 | 3/1989 | Goldner | 248/464 X |
| 5,037,057 | 8/1991 | Andrews | 248/448 X |
| 5,106,048 | 4/1992 | Lebar | 248/460 |

*Primary Examiner*—J. Franklin Foss
*Attorney, Agent, or Firm*—Hughes, Multer & Schacht

[57] ABSTRACT

A music stand extender adapted to be mounted to a conventional music stand in a manner to present an expanded support area. This extender comprises, in a preferred form, three panel sections which in an expanded position rest against a back portion of the music stand, and three flange sections that are positioned on a lower ledge portion of the stand. The extender can be folded over on itself to function as a sheet music container and carrier, and can be extended to its support position to be placed on a music stand.

22 Claims, 4 Drawing Sheets

MUSIC SUPPORT APPARATUS AND METHOD

BACKGROUND OF THE INVENTION

1. Field of the Invention

The present invention relates to a sheet music support apparatus such as those which support sheet music for a musician, and more particularly to an apparatus and method by which the effective support area of a music stand can be extended by such apparatus. Also, the present invention relates to such a method and support apparatus where the apparatus has a collapsed position where sheet music can be stored in a protected position, and the apparatus can act as a carrier for the same.

2. Background Art

A conventional music stand comprises a music sheet support section that is generally mounted to a vertically adjustable column or post, which in turn is supported from the floor by a base member, such as a three legged base support. The music sheet support member comprises a main planar plate or back member, with a forwardly facing lower lip or ledge that extends outwardly at 90° from the back member to support the bottom edge of the sheet music, and with the sheet music laying against the main plate member. Quite commonly, the music sheet support section has a vertical dimension approximately the same as the height of the sheet music (generally about 9 to 12 inches) and a lateral dimension between about 8 to 10 inches).

There are also in the prior art other types of music sheet support devices, and some of these take the form of a framework made of several flattened elongate metal pieces interconnected with one another so that these can be moved to an outwardly extending support position, and then also collapsed in a stowed position.

It has long been recognized that there is often a need to have a music sheet support stand which has a greater lateral dimension. For example, two musicians may be using a single music stand, with each musician having his (or her) own sheet music on the stand. Or it may be that the sheet music itself extends laterally beyond the side edges of the music sheet support section of the conventional stand. There are in the prior art mechanisms to extend the music stand. One of these is U.S. Pat. No. 4,312,490, entitled "MUSIC STAND EXTENDER", (naming the present applicant as the inventor). This patent discloses two extensions which fit in telescoping relationship over a conventional music stand having a generally rectangular back member plus the forwardly extending lip or ledge. The two extensions interfit with the music support section in a slide/-telescoping relationship where they can be moved inwardly to provide a music sheet support surface of a smaller size or extended outwardly.

Another music stand extending device is shown in U.S. Pat. No. 4,372,518 (the present applicant being the patentee in the patent also.)

While the extension device shown in the above patents certainly represent valuable contributions in meeting this need for an extendable music stand, there are other situations which present somewhat different problems. For example, the musician may find that he has a present need for an extended music support stand and one is not available. Also, there is the consideration that most any device becomes more useful if, in addition to serving a primary function, can also serve some auxiliary useful function.

This device is similar to that shown in U.S. Pat. No. 4,372,518 but is adapted to be mounted to the second type of music stand, as described above, where there is a framework of elongate metal pieces.

SUMMARY OF THE INVENTION

The present invention comprises a stand extender and method which is arranged to be adaptable to most types (if not most any type) of stands such as music stands, of conventional design. Also, the present invention provides such an extender (and method of using the same) which in addition to providing an extended support area for sheet material, such as sheet music, serves as a portable container/carrier for sheet music or other material.

The present invention comprises a stand and stand extender combination, the stand extender itself, and also a method of using the same.

The music stand which is used in the combination comprises a sheet material support section which has a forward side and a rear side. It comprises a main back support providing a substantial planar forward support surface adapted to engage sheet material (such as sheet music) which can be positioned against the support surface. The back support has upper and lower edges and side edges.

The support section has a bottom ledge support means extending forwardly from a lower portion of the back support, and also positioned to engage and support a lower edge of the sheet material. The support section has a lateral dimension extending between side edges of the back support, and a vertical dimension extending from the ledge means to the upper edge of the back support.

The stand extender comprises a panel section portion and a flange portion. The panel section portion comprises a plurality of panel sections, each having opposite side edges and upper and lower edges. The panel sections each have am least one panel hinge connection to an adjacent panel section along a related vertical panel hinge axis and along an adjacent side edge of the adjacent panel section. This panel hinge connection restrains relative movement between adjacent panel sections to articulating motion about the vertical panel hinge axis.

The flange portion comprises a plurality of flange sections, with each flange section having opposite side edges and rear and front edges. Each flange section has a flange/panel hinge connection at the rear edge of the flange section to an adjacent lower edge of a related panel section along a related panel/flange hinge axis to restrain relative motion between each panel section and its related adjacent panel section to articulating motion about said panel/flange hinge axis.

Also, each flange section has at least one flange hinge connection of one of its side edges to an adjacent side edge or an adjacent flange section about a related flange hinge axis to restrain relative motion between the adjacent flange sections to articulating motion about the flange hinge axis.

The extender has a collapsed position where each panel section is folded along its panel hinge connection so that the panel sections are stacked in overlying relationship with one another and the flange sections are also stacked in overlying relationship.

The extender also has an extended position where the panel sections are in an unfolded configuration at laterally spaced positions in substantial co-planar relationship, where the panel sections collectively present an extended forwardly facing sheet support surface. In the extended position, the flange sections are at laterally spaced positions in substantially coplanar relationship to present an extended bottom support surface. The flange sections are, in the extended position, extending forwardly from the panel sections at an angle having a substantial right angle component relative to the panel section portion. Thus, the flange sections restrain relative angular movement of the panel sections to substantially maintain the panel sections in co-planar relationship, and the panel sections restrain relative angular movement of said flange sections to maintain said flange sections in substantial co-planar alignment.

The extender is arranged to be positioned in its extended position on the music support section of the stand, with the panel section portion being positioned adjacent, and substantially parallel to, the back support of the stand. The flange portion is positioned adjacent to, and generally parallel to, the bottom support means of the stand. The extender in its extended position has a lateral length dimension greater than the lateral dimension of the sheet support section of the stand, so that outer portions of the extender extend beyond the side edges of the sheet support section to present a laterally extended support for sheet material.

In a preferred configuration, there are at least three panels and at least three related flange sections, namely a middle panel section, a middle flange section, two outer panel sections and two outer flange sections. The hinge connections between the middle panel section and the middle flange section with at least one of the outer panel section and its related flange section, have a sufficient width dimension so that with the other ones of the panel section and flange section folded over on the middle panel section and flange section, the hinge connections of the at least one panel section and its related flange section provide a space therebetween to accommodate the other panel section and flange section.

Also, in a preferred form, there is at least one pocket member positioned on a surface of at least one extender portion comprising one of the panel sections and its related flange section, receive sheet material therein in generally coplanar relationship with the extender portion.

Also, in the preferred embodiment, there is a retaining member extending laterally along a back surface portion of the extender and positioned to engage the back support of the stand to restrain the extender from moving away from the back support.

A preferred configuration of the extender is that it comprises a plurality of at least semi-rigid panel plate portions corresponding in configuration to each panel section, and a plurality of semi-rigid flange plate portions corresponding in size and configuration to the flange sections. The panel plate portions and the flange plate portions are positioned between front and rear sheets. These sheets are joined one to another at perimeter portions thereof to enclose the plate portions, and the front and rear sheets are also joined to one another at hinge locations of the plate portions. Desirably, the front and rear sheets are heat sealed to one another at least along some of the perimeter portions and hinge connections.

DESCRIPTION OF PREFERRED EMBODIMENTS

Figure 1:
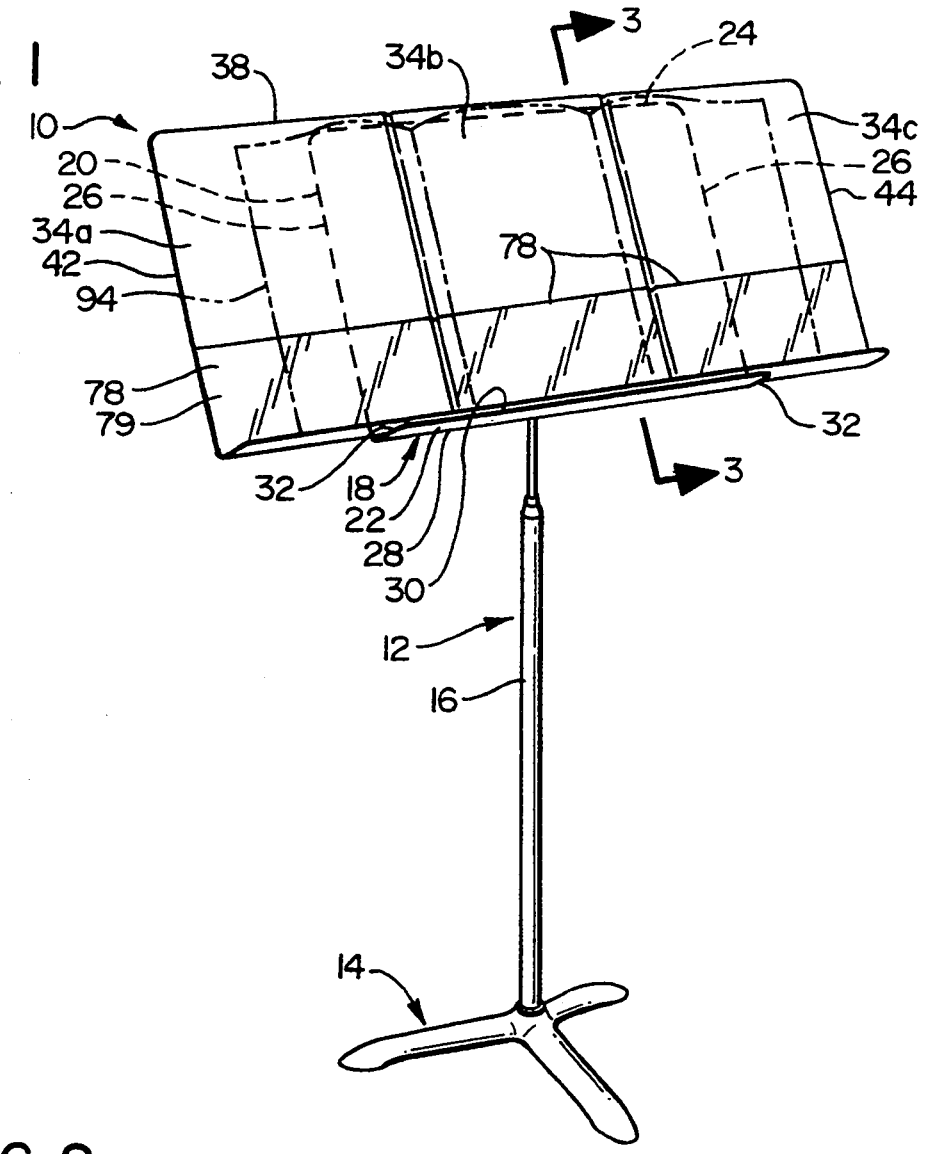
FIG. 1 is an isometric view showing the music stand extender of the present invention being mounted to a conventional music stand in its expanded position.

In FIG. 1, the music stand extender 10 of the present invention is shown being mounted in its extended music sheet support position for music sheet, with the extender 10 positioned on a music stand 12. The music stand 12 is, or may be of itself of conventional design. As shown herein, the stand 12 comprises a floor engaging base 14 comprising three legs extending radially outwardly from one another at 120°, an adjustable column or post 16, and a music sheet support section 18. The music sheet support section 18 comprises a main planar or plate-like back support 20, having a generally rectangular configuration, and a lower forwardly extending lip or ledge 22. When the music sheet support section 18 is used by itself (without the extender 12), the sheet music is positioned with its lower edge resting against the lip or ledge 22, and its back surface resting against the back support 20. It is common that the music sheet support section 18 is adjustably mounted as indicated at 23, to the column or post 16 so that its angular position relative to the post 16 can be adjusted. In practice, to properly support the sheet music and display it at the proper angle for the musician, the support section 18 will normally slant in an upward direction away from the musician.

The back support plate 20 has an upper edge 24, two side edges 26 and a bottom edge 28. The lip or ledge 22 is connected by its rear edge to the bottom edge 28 of the back support, and has a front edge 30 and two side edges 32. It is common for the lip or ledge 22 to be formed integrally with the back support 20, so as to extend outwardly from the plane of the back support at a right angle.

For ease of description, the term "upper" shall refer to the location of the upper edge 24 of the back support 20 and the term "lower" shall refer to the location of the lower edge 28, even though the support section 18 is usually positioned at a slant. The term "outward" shall refer to a lateral location positioned away from the vertical center line 33 of the back support 20. The term "forward" shall denote the surface of the back support 20 against which the sheet music rests, and the term "back" or "rear" shall denote the opposite side of the back support 20 at which the pivot connection 23 is made. Thus, for ease of description, even though the music sheet support section 18 is commonly positioned at a slant, the term "vertical" or "vertical axis" shall refer to the upwardly slanting line or axis 33 that lies in the plane of the back support 20 and is perpendicular to the upper and lower edges 24 and 28.

The extender 10 comprises a panel section portion 34 made up of three panel sections 34*a*, 34*b* and 34*c*, and a flange section portion 36, made up of three flange sections 36*a*, *b* and *c*. Each panel section 34*a*, *b* or *c* has an upper edge 38 and a lower edge 40. The two outer panel sections 34*a* and 34*c* have outside edges at 42 and 44, respectively. The two lateral edges of the center panel section 34*b* are designated 46 and each of these has a hinge connection 48 to the adjacent inside edges 50 of the outward panel sections 34*a* and 34*c*.

Each flange section 36*a*, *b* and *c* has a rear edge 52 and a forward edge 54. The two outer flange sections 36*a* and 36*c* have outside edges and 58. The rear edge 52 of each of the flange sections 36*a*, *b* and *c* is connected by a hinge connection 60 to the lower edge 40 of its related panel section 36*a*, *b* or *c*, respectively. The inner edge 62 of each of the outer flange sections 36*a* and 36*c* is connected by a hinge connection 64 to an adjacent edge of the center flange section 36*b*.

The overall construction of the extender 10 can conveniently be manufactured by providing three larger substantially rigid rectangular panel plates 68, each having the configuration of the panels 34*a*, 34*b* and 34*c* and also three substantially rigid rectangular flange plates There are provided two planar sheets 72 and 74, with the sheet 72 extending over the entire front face surfaces of the plates 68 and 70, and the back sheet 74 extending along the back side of these plates 68 and 70. Then the two sheets 72 and 74 are bonded to one another around their entire perimeter portions as shown at 76. Further, the two sheets 72 and 74 are bonded one to the other at each of the hinge connections 48, 60 and 64. This can conveniently be accomplished by the sheets 72 and 74 being made of a thermal plastic or a thermal setting material, and heat sealing the two sheets 72 and 74 at the perimeter line and at the hinge lines, 4, 8, 60 and 14.

There is provided at the lower front portion of the three panel sections 34*a*, *b* and *c* three flexible pocket members 78. These pocket members 78 can be made quite simply by providing a single plastic sheet 79 extending over the entire lower front surface of the panels 34*a*, *b* and *c* on the outside of the forward cover sheet 72. The lower and side edges or seams of each pocket 78 coincide with the related panel edges lines 40, 42 and 44, and can simply be made by heat bonding these edges of the pocket members 78 at the panel edges 40, 42 and 44. The separate pockets 78 can be formed by binding the sheet 79 to the sheet 72 at the hinge lines 48. It can be seen (see FIG. 6) that materials such as sheet music 80 or similar articles can be placed within all or any one of the pockets 78.

On the upper back side of the panels 34*a*, *b* and *c*, there is provided a retaining sheet 82 which is bonded at its top edge 84 to the upper edge portion of the back sheet 74. The side edges 86 of this back retaining sheet 82 are bonded to the back sheet 74 at the upper side edges 86 and at the upper side perimeter portions of the two outside panels 34*a* and 34*c*. The function of this retaining sheet 82 is to define a downwardly open pocket 88 that receives the upper portion of the back support 20 of the music stand 12 when the extender 10 is being mounted to the music sheet support section 18.

Figure 2:
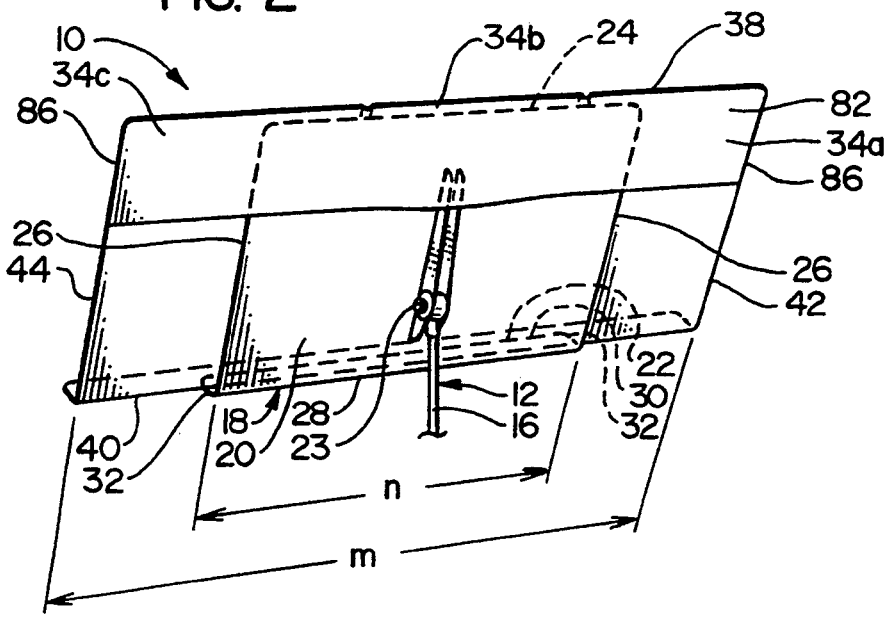
FIG. 2 is an isomeric view of the music stand extender mounted to a music stand, this view being taken from a position looking at the backside of the stand.
Figure 4:
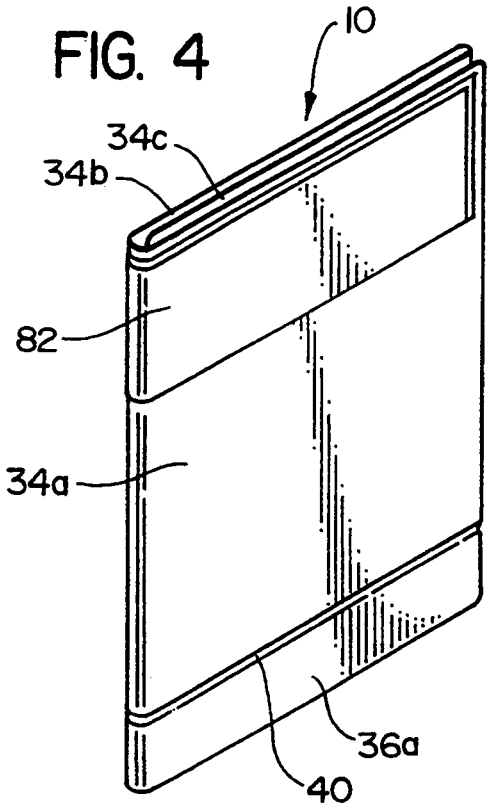
FIG. 4 is an isometric view illustrating the music stand extender in its collapsed position in which it can easily be carried or fitted into (for example) a briefcase or similar carrier, and in which it can itself function as a carrier for sheet music.
Figure 6:
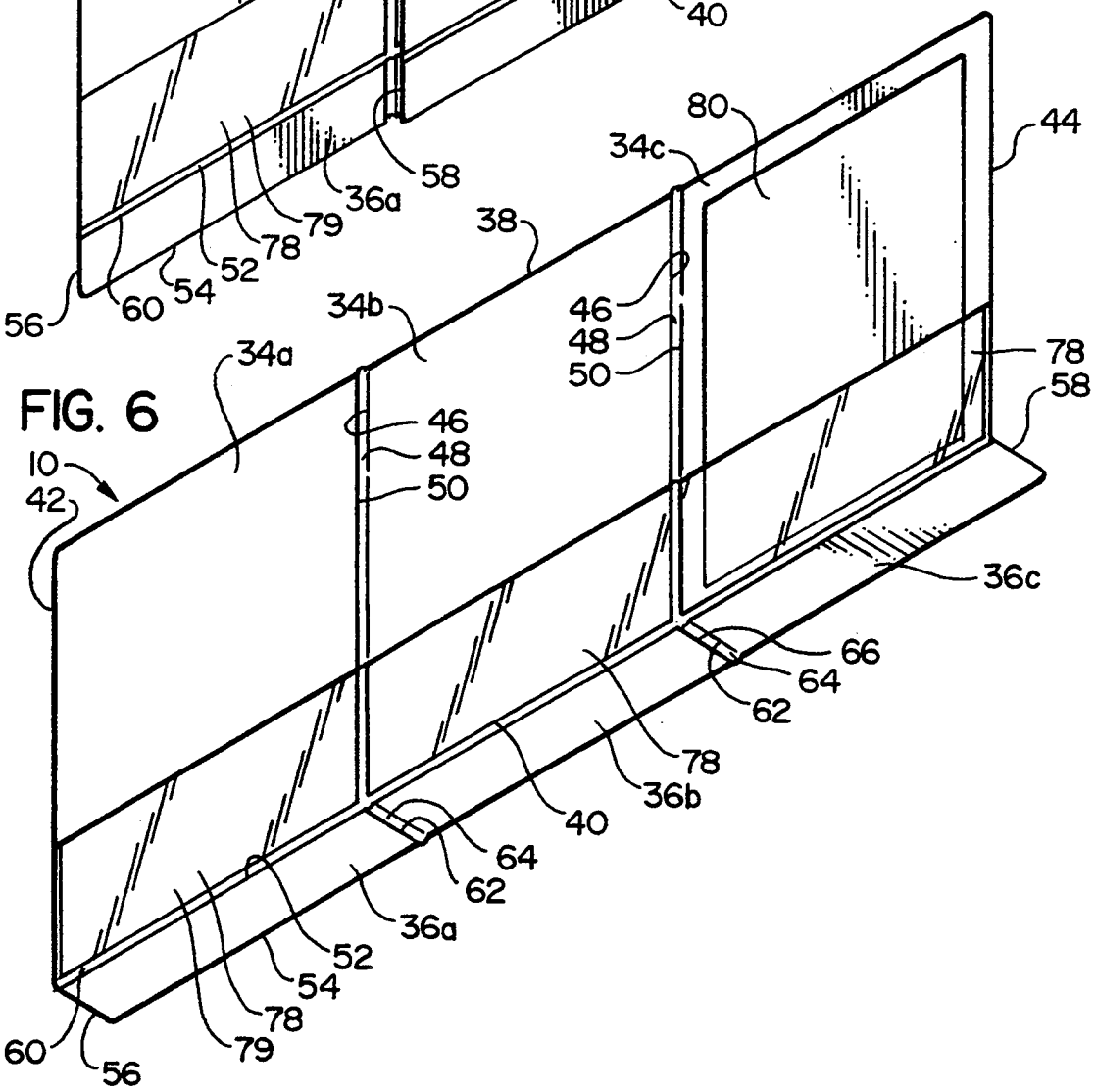
FIG. 6 is an isometric view similar to FIG. 5, but showing the extender in its fully expanded position, with the flange sections being positioned at right angles relative to the panel sections to provide proper support for sheet music.

To describe the operation of the present invention, it should first be recognized that the extender 10 of the present invention has two operating positions, namely an extended support position (as shown in FIGS. 1, 2, and 6), and a closed collapsed position (as shown in FIG. 4), where it performs a containing and/or carrying function for sheet music or other similar articles.

The expanded position will be described first, and reference is made initially to FIG. 6. In the expanded operating condition, the three panel sections 34*a*, 34*b* and 34*c* are at laterally spaced positions adjacent to one another, aligned substantially in a single plane. In like manner, the lower three flange sections 36*a*, 36*b* and 36*c* are also at laterally spaced positions, and lie in a single plane which is substantially perpendicular to the plane occupied by the panel sections 34*a*, *b* and *c*.

In the position of FIG. 6, the expander 10 is placed on a music stand (see FIGS. 1 and 2) so that the three panel sections 34*a*, *b* and *c* rest against the front surface 92 of the back support 18. The three flange sections 36*a*, *b* and *c* rest against the lower ledge or lip 22 of the back support 18, and the hinge line 60 between the set of three panel sections 34*a*, *b* and *c* and the flange sections 36*a*, *b* and *c* is adjacent to the lower edge 28 of the back support 20 where the lip or ledge 22 meets the back support 20.

It will be noted that the lateral lengthwise dimension (indicated at "m") of the expander 10 in its expanded position is greater than the lateral lengthwise dimension (indicated at "n") of the sheet music support section 18 of the music stand 12. Thus, both the outer portions of the outer panel sections 34*a* and 34*c* and also the outer portions of the outer flange sections 36*a* and 36*c* extend beyond the lateral edges 26 of the back support 20 and beyond the lateral edges 32 of the lip or ledge 22.

However, it should be noted that even though the outer lateral portions of the expander 10 are in a sense cantilevered outwardly from the music holding section 18 of the stand 12, the entire extender 10 provides a stable support for the sheet music (such sheet music being shown in broken lines at 94 resting upon the extender 10). The reason for this is that with the flange sections 34*a*, *b* and *c* being constrained so as to be extending at right angles to the three panel sections 34*a*, *b* and *c*, structurally, the extender 10 is a relatively rigid beam, and will deviate from being a rigid structure only by the small amount of the "wobble" will be tolerated by the "give" in each of the hinge lines 48, 60 or For example, with reference to FIG. 6, the panel section 34*a* is considered. It will be noted that the hinge connection 48 will permit movement of the panel 38 only in a horizontal plane perpendicular to the axis 48 of the hinge connection. However, such swing motion about the hinge 48 is resisted by the two hinge connections 60 and 62 of the adjacent flange section 36*a*.

In like manner, the hinge lines 64 on the lateral edge of the flange section 36*a* will permit only upward and downward rotational movement about the hinge line 64. However, such movement is prohibited by the connection of the hinge line 60 to the panel section 34*a*. When the extender 10 is positioned with its flange sections 36*a*, *b* and *c* perpendicular to the panel sections 34*a*, *b* and *c* and when this extender 10 is then placed in its operating position on the sheet music support section 18 of the stand 12, the right angle alignment of the panel sections 34*a*, *b* and *c* is maintained with the flange sections 36*a*, *b* and *c*.

Further, the outer flange sections 36*a* and 36*c* are not allowed to have their front edges dropped downwardly, both because of the support provided by the ledge or lip 22, and also by the action of the hinge lines 62 maintaining these flange sections 36*a* and 36*c* in substantial horizontal alignment with the center flange section 36*b*. Nor are the two outer flange sections 36*a* and 36*c* permitted to rotate downwardly about the hinge axes 64, because of the restraining action of the hinge lines 48 acting at the panel sections 34*a* and 34*c*. Also, it can readily be seen that the panel sections 34*a* and 34*c* are prevented from rotating rearwardly because of the flange sections 36*a* and 36*c* being restrained from such movement by the hinge lines 64.

Further, it should be noted that with the retaining sheet 82 overlapping the upper portion of the back support 20 this holds the upper portion of the middle panel section 34*b* more closely to the upper part of the back support 20, thus stabilizing the expander 10 as being a structural extension of the music stand section 18.

Thus, it can be appreciated that the extender 10, in its extended operating position and placed on a sheet music holding portion 18 of the stand 12, presents a stable expanded mounting area for the sheet music 94.

Figure 5:
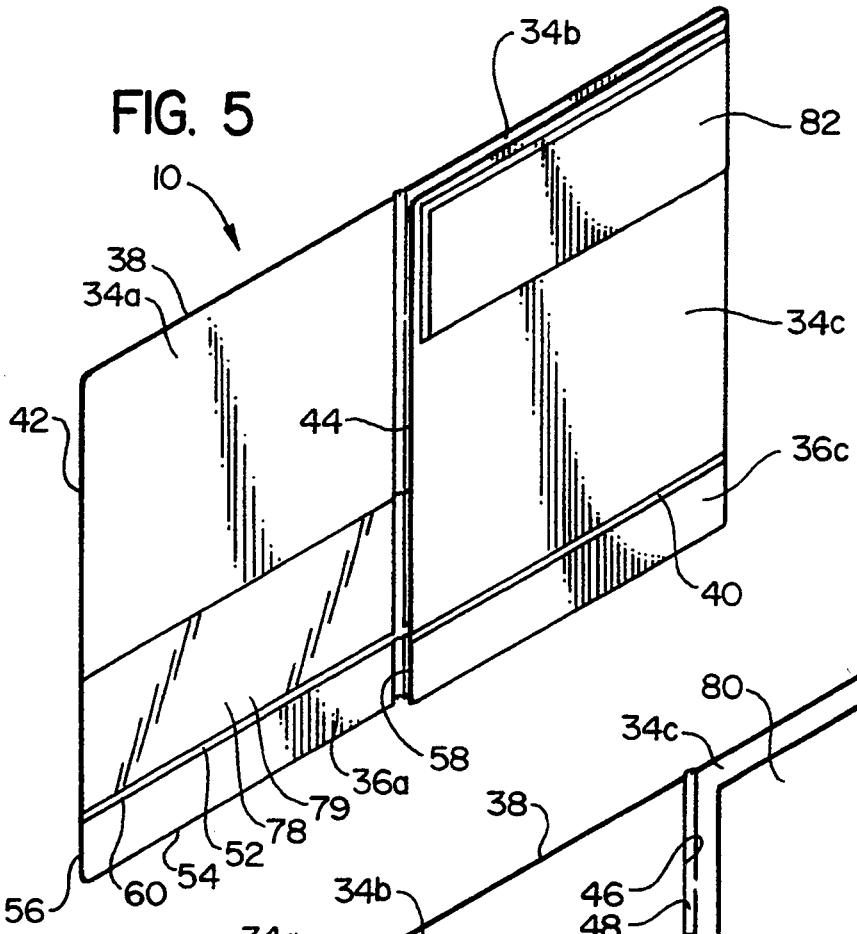
FIG. 5 is an isometric view showing the music stand extender with one panel/flange section being positioned outwardly toward the extended position.

Let it now be assumed that it is desired to dismount the expander 10 from the support section 18 and place it in its collapsed condition. This is quite simply accomplished by moving the flange sections 36*a, b* and *c* downwardly from the position shown in FIG. 6 so that these lie on the same plane as the panel sections 34*a, b* and *c*. Then one of the panel sections (panel section 34*c* as shown in FIG. 5) is folded over on its related hinge line 48 so as to overlie the panel section 34*b*, with the flange section 36*b* overlying the flange section 36*a*. Then the third panel section 34*a*, with the flange 36*a* is simply folded over along its related hinge line 48 (and along the hinge line 64) to overlie the panel section 34*c*.

With the expander 10 folded over in its collapsed position shown at FIG. 4, this expander 10 can simply be carried separately by the user. At the same time, it can function as a storage container for the music sheets which are held in the interior pockets 78. Alternatively, the extender 10, in its stowed configuration of FIG. 4, can simply fit into another carrying case rather conveniently.

The hinge connections 48 and 62 are made with a sufficient width so that when one of the sections 34*a* or 34*c* is folded over onto the middle section 34*b*, there is a certain amount of spacing between that panel section 34*a* or 34*c* and the panel section 34*b*. The reason for this is that after one section 34*a* or 34*c* is folded over (as shown in FIG. 5), there is sufficient width in the hinge connection 48 of the other panel section 34*a* to permit it to be folded over and lay flat against the panel section 34*c*. In like manner, this same construction is present in the hinge connections 64 between the flange sections 36*a, b* and *c*, respectively.

Figure 3:
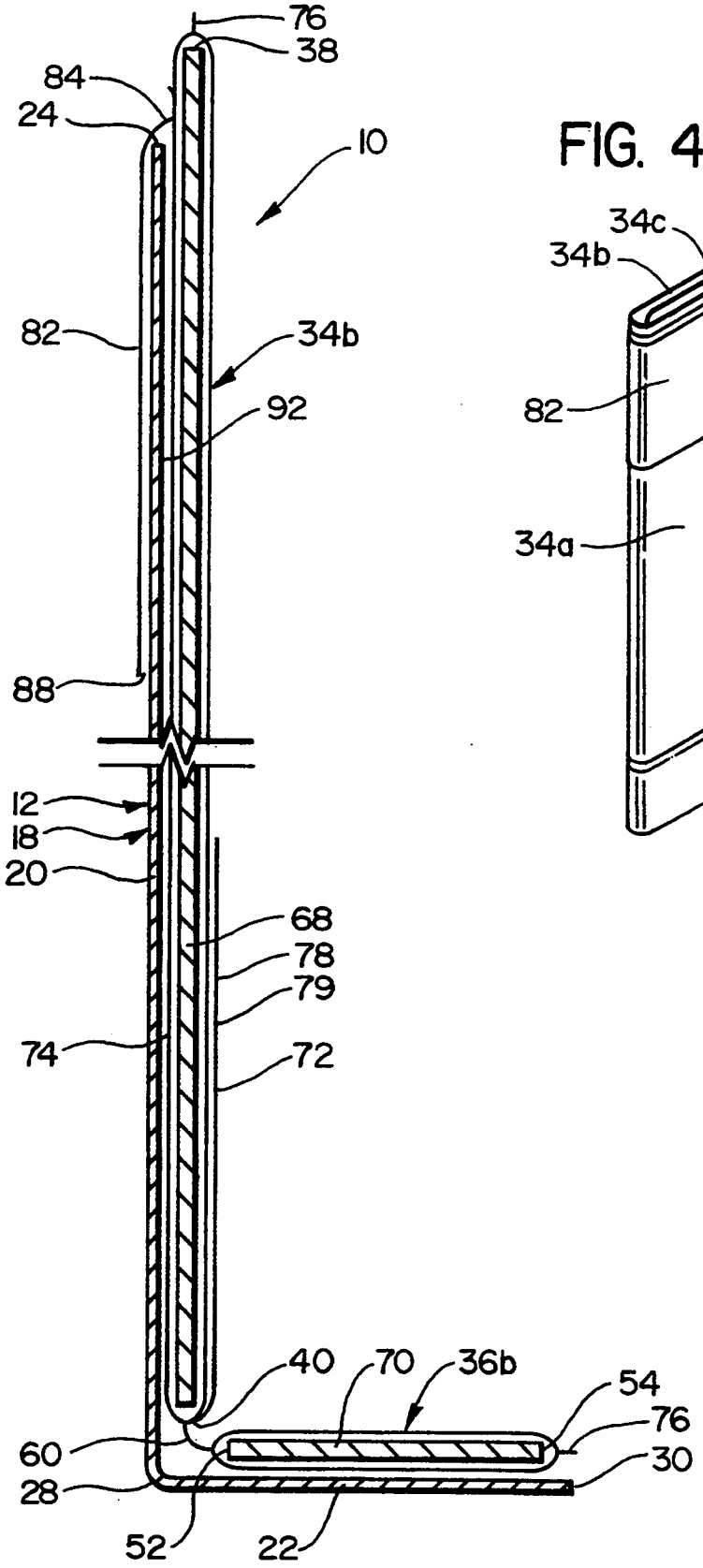
FIG. 3 is a sectional view taken along line 3—3 of FIG. 1.
Figure 7:
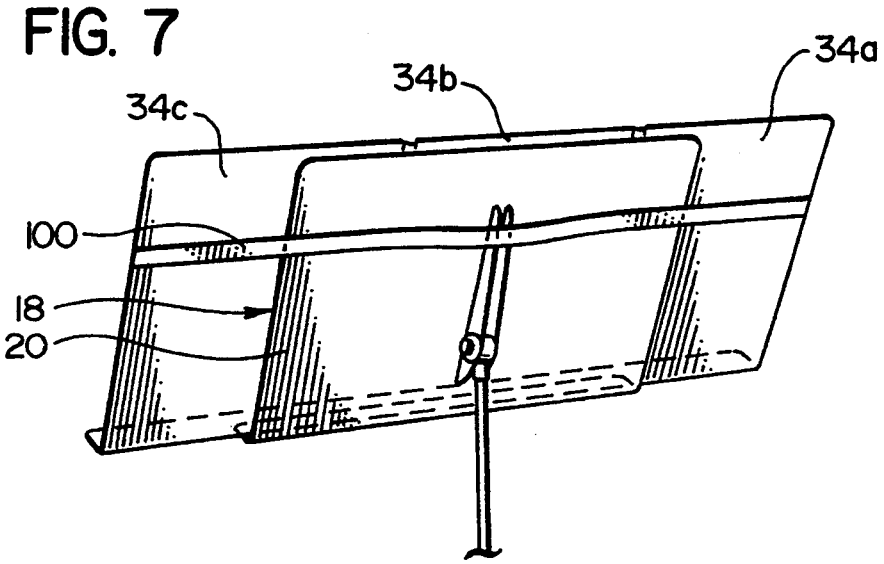
FIG. 7 is a view similar to FIG. 2, but showing an alternative embodiment of the present invention.

FIG. 7 shows an alternative embodiment of the present invention. This second embodiment is substantially the same as the first embodiment, except that instead of providing a retaining sheet 82 (see FIG. 3) to engage the upper portion of the back support 20, there is provided a strap 100 which extends along the upper back portion of he panel sections 34*a, b* and *c*. Since the apparatus of FIG. 7 is in other respects substantially the same as the first embodiment of FIGS. 1–6, there will be no further description of this second embodiment.

The present invention has been described in its preferred configuration and preferred application as it relates to the specific problem of providing an expanding function for a conventional music stand, and in describing this preferred embodiment, reference has been made to sheet music, a music stand, etc. It is to be understood, that within the broader aspects of the present invention, there may be application to certain other uses where similar problems and considerations are present.

It is also to be understood that while the language of the claims recited herein refer specifically to items such as "sheet music" and other components where the word "music" is used, the claims are to be interpreted to give proper scope to the novel features of the present invention and could (while being consistent with the limitations placed upon the claims by the prior art) be applied to components, uses and applications not necessarily directly relating to music, sheet music or a music stand.

It is to be understood that various modifications could be made to the present invention without departing from the basic teachings thereof.

What is claimed:

1. A stand, such as a music stand, and stand extender combination, comprising:

a. a stand having a sheet material support section which has a forward side and a rear side and comprises:

i. a main back support providing a substantially planar forward support surface adapted to engage sheet material which can be positioned against the support surface, said back support having upper and lower edges and side edges;

ii. a bottom ledge support means extending forwardly from a lower portion of said back support and positioned to engage and support a lower edge of said sheet material;

iii. said support section having a lateral dimension extending between side edges of said back support, and a vertical dimension extending from said ledge means to the upper edge of the back support;

b. a stand extender comprising:

i. a panel section portion comprising a plurality of panel sections, each having opposite side edges and upper and lower edges, said panel sections each having at least one panel hinge connection to an adjacent panel section along a related vertical panel hinge axis and along an adjacent side edge of said adjacent panel section, to restrain relative movement between said adjacent panel sections to articulating motion about said vertical panel hinge axis;

ii. a flange portion comprising a plurality of flange sections, each flange section having opposite side edges and rear and front edges;

iii. each flange section having a flange/panel hinge connection at the rear edge of the flange section to an adjacent lower edge of a related panel section along a related panel/flange hinge axis to restrain relative motion between each panel section and its related adjacent flange section to articulating motion about said panel/flange hinge axis;

iv. each flange section having at least one flange hinge connection of one of its side edges to an adjacent side edge of an adjacent flange section about a related flange hinge axis to restrain relative motion between the adjacent flange section to articulating motion about the flange hinge axis;

c. said extender having a collapsed position where each panel section is folded over along its panel hinge connection so that the panel sections are stacked in overlying relationship with one another and said flange sections are also in stacked overlying relationship;

d. said extender having an extended position where:

i. said panel sections are in an unfolded configuration at laterally spaced positions in substantial co-planar relationship, where the panel sections collectively present an extended forwardly facing sheet support surface;

ii. said flange sections are at laterally spaced positions in substantially co-planar relationship to present an extended bottom support surface;

iii. said flange sections extending forwardly from said panel sections at an angle having a substantial right angle component, in a manner that said flange sections restrain relative angular movement of said panel sections to substantially maintain said panel sections in co-planar relationship, and said panel sections restrain relative angular movement of said flange sections to maintain said flange sections in substantial co-planar alignment;

e. said extender being arranged to be positioned in its extended position on said support section of said stand with said panel section portion positioned adjacent, and substantially parallel to, said back support of the stand, and with said flange portion being positioned adjacent to, and generally parallel to, the bottom support means of the stand, said extender in its extended position having a lateral length dimension greater than the lateral dimension of the sheet support section of the stand, so that outer portions of the extender extend beyond the side edges of the sheet support section to present a laterally extended support for sheet material.

2. The combination as recited in claim 1, wherein there are at least three panel sections and at least three related flange sections, with there being a middle panel section, a middle flange section, two outer panel sections and two outer flange sections.

3. The combination as recited in claim 2, wherein the hinge connections between the middle panel section and the middle flange section, with at least one of the outer panel sections and its related flange section, have a sufficient width dimension so that with the other one of said panel section and flange section folded over on the middle panel section and flange section, the hinge connections of the at least one panel section and its related flange section provide a space therebetween to accommodate the other panel section and flange connection.

4. The combination as recited in claim 3, wherein there is at least one pocket member positioned on a surface of at least one extender portion comprising one of said panel sections and its related flange section, to receive a sheet material therein in generally co-planar relationship with the extender portion.

5. The combination as recited in claim 1, wherein there is at least one pocket member positioned on a surface of at least one extender portion comprising one of said panel sections and its related flange section, to receive a sheet material therein in generally co-planar relationship with the panel portion.

6. The combination as recited in claim 1, wherein there is a retaining member extending laterally along a back surface portion of said extender and positioned to engage said back support of the stand to restrain said extender from moving away from said back support.

7. The combination as recited in claim 1, wherein said extender comprises a plurality of at least semi-rigid panel plate portions corresponding in configuration to each panel section, and a plurality of semi-rigid flange plate portions corresponding in size and configuration to the flange sections, said panel plate portions and said flange plate portions being positioned between front and rear sheets, with said sheets being joined one to another at perimeter portions thereof to enclose said plate portions, and with said front and rear sheets also being joined one to another at hinge locations of said plate portions.

8. The combination as recited in claim 7, wherein said front and rear sheets are heat sealed to one another at least along some of said perimeter portions and hinge connections.

9. A stand extender adapted to be used in combination with a stand, such as a music stand, having a sheet material support section which has a forward side and a rear side and comprises:

a. a main back support providing a substantially planar forward support surface adapted to engage sheet material which can be positioned against the support surface, said back support having upper and lower edges and side edges;

b. a bottom ledge support means extending forwardly from a lower portion of said back support and positioned to engage and support a lower edge of said sheet material;

c. said support section having a lateral dimension extending between side edges of said back support, and a vertical dimension extending from said ledge means to the upper edge of the back support;

said stand extender comprising:

a. a panel section portion comprising a plurality of panel sections, each having opposite side edges and upper and lower edges, said panel sections each having at least one panel hinge connection to an adjacent panel section along a related vertical panel hinge axis and along an adjacent side edge of said adjacent panel section, to restrain relative movement between said adjacent panel sections to articulating motion about said vertical panel hinge axis;

b. a flange portion comprising a plurality of flange sections, each flange section having opposite side edges and rear and front edges;

c. each flange section having a flange/panel hinge connection at the rear edge of the flange section to an adjacent lower edge of a related panel section along a related panel/flange hinge axis to restrain relative motion between each panel section and its related adjacent flange section to articulating motion about said panel/flange hinge axis;

d. each flange section having at least one flange hinge connection of one of its side edges to an adjacent side edge of an adjacent flange section about a related flange hinge axis to restrain relative motion between the adjacent flange section to articulating motion about the flange hinge axis;

e. said extender having a collapsed position where each panel section is folded over along its panel hinge connection so that the panel sections are stacked in overlying relationship with one another and said flange sections are also in stacked overlying relationship;

f. said extender having an extended position where:

i. said panel sections are in an unfolded configuration at laterally spaced positions in substantial co-planar relationship, where the panel sections collectively present an extended forwardly facing sheet support surface;

ii. said flange sections are at laterally spaced positions in substantially co-planar relationship to present an extended bottom support surface;

iii. said flange sections extending forwardly from said panel sections at an angle having a substantial right angle component, in a manner that said flange sections restrain relative angular movement of said panel sections to substantially maintain said panel sections in co-planar relationship, and said panel sections restrain relative angular movement of said flange sections to maintain said flange sections in substantial co-planar alignment;

whereby said extender being arranged to be positioned in its extended position on said support section of said stand with said panel section portion positioned adjacent, and substantially parallel to, said back support of the stand, and with said flange portion being positioned adjacent to, and generally parallel to, the bottom support means of the stand, said extender in its extended position having a lateral length dimension greater than the lateral dimension of the sheet support section of the stand, so that outer portions of the extender extend beyond the side edges of the sheet support section to present a laterally extended support for sheet material.

10. The extender as recited in claim 9, wherein there are at least three panel sections and at least three related flange sections, with there being a middle panel section, a middle flange section, two outer panel sections and two outer flange sections.

11. The extender as recited in claim 10, wherein the hinge connections between the middle panel section and the middle flange section, with at least one of the outer panel sections and its related flange section, have a sufficient width dimension so that with the other one of said panel section and flange section folded over on the middle panel section and flange section, the hinge connections of the at least one panel section and its related flange section provide a space therebetween to accommodate the other panel section and flange connection.

12. The extender as recited in claim 11, wherein there is at least one pocket member positioned on a surface of at least one extender portion comprising one of said panel sections and its related flange section, to receive a sheet material therein in generally co-planar relationship with the extender portion.

13. The extender as recited in claim 9, wherein there is at least one pocket member positioned on a surface of at least one extender portion comprising one of said panel sections and its related flange section, to receive a sheet material therein in generally co-planar relationship with the panel portion.

14. The extender as recited in claim 9, wherein there is a retaining member extending laterally along a back surface portion of said extender and positioned to engage said back support of the stand to restrain said extender from moving away from said back support.

15. The extender as recited in claim 9, wherein said extender comprises a plurality of at least semi-rigid panel plate portions corresponding in configuration to each panel section, and a plurality of semi-rigid flange plate portions corresponding in size and configuration to the flange sections, said panel plate portions and said flange plate portions being positioned between front and rear sheets, with said sheets being joined one to another at perimeter portions thereof to enclose said plate portions, and with said front and rear sheets also being joined one to another at hinge locations of said plate portions.

16. The extender as recited in claim 7, wherein said front and rear sheets are heat sealed to one another at least along some of said perimeter portions and hinge connections.

17. A method of extending a support area of a stand, such as a music stand, where said stand has a sheet support section which has a forward side and a rear side and comprises:

a. a main back support providing a substantially planar forward support surface adapted to engage sheet material which can be positioned against the support surface, said back support having upper and lower edges and side edges;

b. a bottom ledge support means extending forwardly from a lower portion of said back support and positioned to engage and support a lower edge of said sheet material;

c. said support section having a lateral dimension extending between side edges of said back support, and a vertical dimension extending from said ledge means to the upper edge of the back support;

said method comprising:

a. providing a stand extender comprising:

i. a panel section portion comprising a plurality of panel sections, each having opposite side edges and upper and lower edges, said panel sections each having at least one panel hinge connection to an adjacent panel section along a related vertical panel hinge axis and along an adjacent side edge of said adjacent panel section, to restrain relative movement between said adjacent panel sections to articulating motion about said vertical panel hinge axis;

ii. a flange portion comprising a plurality of flange sections, each flange section having opposite side edges and rear and front edges;

iii. each flange section having a flange/panel hinge connection at the rear edge of the flange section to an adjacent lower edge of a related panel section along a related panel/flange hinge axis to restrain relative motion between each panel section and its related adjacent flange section to articulating motion about said panel/flange hinge axis;

iv. each flange section having at least one flange hinge connection of one of its side edges to an adjacent side edge of an adjacent flange section about a related flange hinge axis to restrain relative motion between the adjacent flange section to articulating motion about the flange hinge axis;

b. initially positioning said extender in a collapsed position where each panel section is folded over along its panel hinge connection so that the panel sections are stacked in overlying relationship with one another and said flange sections are also in stacked overlying relationship;

c. positioning said extender in an extended position where:

i. said panel sections are in an unfolded configuration at laterally spaced positions in substantial co-planar relationship, where the panel sections collectively present an extended forwardly facing sheet support surface;

ii. said flange sections are at laterally spaced positions in substantially co-planar relationship to present an extended bottom support surface;

iii. said flange sections extending forwardly from said panel sections at an angle having a substantial right angle component, in a manner that said flange sections restrain relative angular movement of said panel sections to substantially maintain said panel sections in co-planar relationship, and said panel sections restrain relative angular movement of said flange sections to maintain said flange sections in substantial co-planar alignment;

d. placing said extender in its extended position on said support section of said stand with said panel section portion positioned adjacent, and substantially parallel to, said back support of the stand, and with said flange portion being positioned adjacent to, and generally parallel to, the bottom support means of the stand, said extender in its extended position having a lateral length dimension greater than the lateral dimension of the sheet support section of the stand, so that outer portions of the extender extend beyond the side edges of the sheet support section to present a laterally extended support for sheet material.

18. The method as recited in claim 17, wherein there are at least three panel sections and at least three related flange sections, with there being a middle panel section, a middle flange section, two outer panel sections and two outer flange sections.

19. The method as recited in claim 18, wherein the hinge connections between the middle panel section and the middle flange section, with at least one of the outer panel sections and its related flange section, have a sufficient width dimension so that with the other one of said panel section and flange section folded over on the middle panel section and flange section, the hinge connections of the at least one panel section and its related flange section provide a space therebetween to accommodate the other panel section and flange connection.

20. The method as recited in claim 19, wherein there is at least one pocket member positioned on a surface of at least one extender portion comprising one of said panel sections and its related flange section, said method further comprising placing sheet material in said pocket member in generally co-planar relationship with the extender portion.

21. The method as recited in claim 17, wherein there is at least one pocket member positioned on a surface of at least one extender portion comprising one of said panel sections and its related flange section, said method further comprising placing sheet material in said pocket member, in generally co-planar relationship with the extender portion.

22. The method as recited in claim 17, wherein there is a retaining member extending laterally along a back surface portion of said extender, said method further comprising positioning the extender to engage said back support of the stand to restrain said extender from moving away from said back support.

* * * * *